US005801491A

United States Patent [19]

Canova

[11] Patent Number: 5,801,491

[45] Date of Patent: Sep. 1, 1998

[54] SUPPLY CIRCUIT FOR DISCHARGE LAMPS WITH MEANS FOR PREHEATING THE ELECTRODES

[75] Inventor: Antonio Canova, Montevarchi, Italy

[73] Assignee: Magnetek S.p.A., Siena, Italy

[21] Appl. No.: 674,536

[22] Filed: Jul. 2, 1996

[30] Foreign Application Priority Data

Jul. 5, 1995 [EP] European Pat. Off. ..... 95830286

[51] Int. Cl.[6] ..... H05B 37/02

[52] U.S. Cl. ..... 315/224; 315/105; 315/47; 315/58; 315/209 R

[58] Field of Search ..... 315/47, 62, 57, 315/58, 105, 209 R, 224, 225, 232, 283, 356, DIG. 4, DIG. 5, DIG. 7

[56] References Cited

U.S. PATENT DOCUMENTS

| | | | |
|---|---|---|---|
| 2,231,999 | 2/1941 | Gustin et al. | 176/124 |
| 4,079,292 | 3/1978 | Kaneda | 315/289 |
| 4,307,334 | 12/1981 | Peil et al. | 315/219 X |
| 4,443,740 | 4/1984 | Goralnik | 315/284 |
| 4,511,823 | 4/1985 | Eaton et al. | 315/226 |
| 4,544,862 | 10/1985 | Yamazaki et al. | 315/209 R |
| 4,647,817 | 3/1987 | Fahnrich et al. | 315/104 |
| 4,701,671 | 10/1987 | Stupp et al. | 315/224 |
| 4,730,147 | 3/1988 | Kroening | 315/100 |
| 5,142,202 | 8/1992 | Sun et al. | 315/225 |
| 5,485,060 | 1/1996 | Canova | 315/209 R |

FOREIGN PATENT DOCUMENTS

| | | |
|---|---|---|
| 0 113 451 A1 | 7/1984 | European Pat. Off. . |
| 0 259 646 | 3/1988 | European Pat. Off. . |
| 0 488 478 A2 | 6/1992 | European Pat. Off. . |
| 0 610 642 A1 | 8/1994 | European Pat. Off. . |
| 41 00 349 A1 | 8/1991 | Germany . |
| 43 28 306 A1 | 3/1994 | Germany . |

*Primary Examiner*—Robert Pascal
*Assistant Examiner*—Halssa Philogene
*Attorney, Agent, or Firm*—McGlew and Tuttle

[57] ABSTRACT

The circuit for firing and supplying a discharge lamp, includes:

a load circuit (10), with at least one discharge lamp (L) and a voltage supply for supplying a discharge lamp, a subportion of the circuit is in parallel with the lamp (L). This subportion includes at least one arrangement of capacitors (17, 21) and an inductive impedance which can be varied in a controllable manner in order to modify the value of the total impedance in parallel with the lamp.

20 Claims, 2 Drawing Sheets

Fig. 4
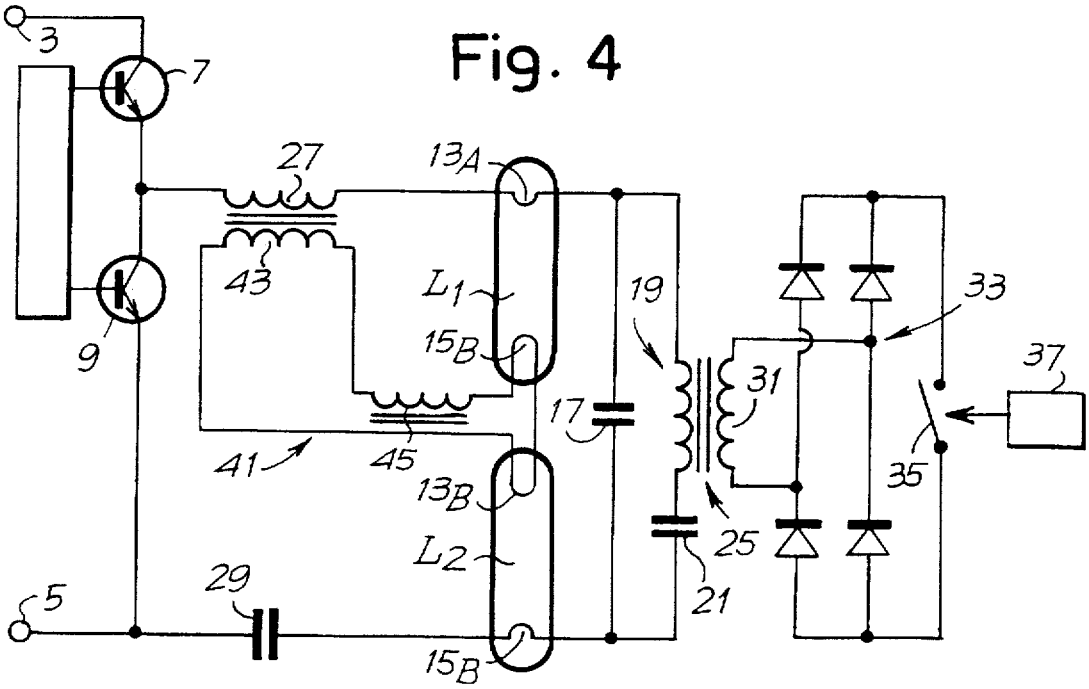
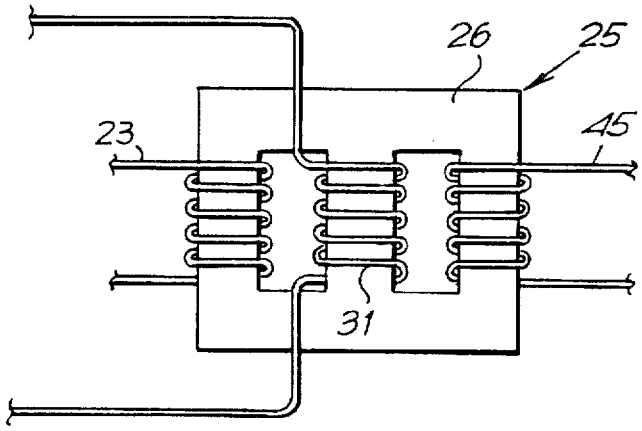
Fig. 5
Fig. 6
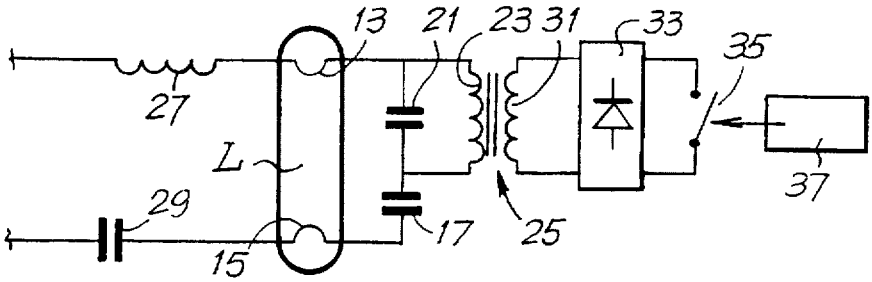

SUPPLY CIRCUIT FOR DISCHARGE LAMPS WITH MEANS FOR PREHEATING THE ELECTRODES

TECHNICAL FIELD

The present invention relates to a circuit for firing and supplying discharge lamps, comprising: a load circuit with at least one discharge lamp; means for supplying the lamp; in parallel with the lamp a circuit comprising at least one arrangement of capacitors with devices which modify the value of the total impedance in parallel with the lamp in order to obtain the pre-heating of the electrodes of the lamp before its firing.

STATE OF THE ART

Devices for supplying discharge lamps at high frequency are known and commonly referred to as ballasts or inverters.

Typical example embodiments of these devices are described in EP-A-0 488 478, U.S. Pat. No. 4,511,823, EP-A-0 610 642, U.S. Pat. No. 4,547,706 (corresponding to EP-A-0 113 451). The general configuration of ballasts is known from these and other prior documents, to which reference may be made for a detailed description.

One of the problems which arises in the use of discharge lamps is represented by the need to obtain correct firing. For this purpose, it is necessary to provide a phase for pre-heating the lamp, with a relatively low voltage across the lamp and a negligible or zero current through this lamp. Having reached a steady temperature, the voltage across the lamp is raised until the lamp is triggered.

To obtain the pre-heating of the electrodes of the lamp it has been proposed (see EP-B-0 185 179) to arrange, in parallel with the lamp, a pair of capacitors in series with each other. The first of the two capacitors is placed in parallel with a resistor having temperature-dependent variable resistance, with a positive temperature coefficient (PTC), that is to say whose resistance increases abruptly upon the reaching of a predetermined temperature. With this arrangement, when the lamp is cold the variable resistance has a very low value, so that the capacitor with which this resistance is placed in parallel is virtually bypassed. The total capacitance in parallel with the lamp is equal to the capacitance of the second capacitor. Under these conditions a high current flow, equal to the current which flows through the electrodes of the lamp and which determines the heating thereof, passes through the variable resistance. The current which flows through the resistor increases its temperature until it reaches the value which causes the abrupt increase in the resistance. When this occurs the two capacitors are in parallel and this modifies the resonant frequency, inducing the circuit to trigger the discharging of the lamp. Essentially, there is provision to act on the value of the resistive component of the impedance in parallel with the lamp in order to modify, at an instant depending on the characteristic of the PTC, the value of the total impedance in parallel with the lamp.

This solution has the drawback that switching from a pre-heating operating condition to the condition of triggering the lamp is controlled by the temperature of the resistor, this being a parameter which cannot be altered. Moreover, the resistors with temperature-dependent variable resistance which are available commercially have a limited number of values of the cut-in threshold. These threshold values are not always optimal.

Other pre-heating circuits make use of variable resistances with negative temperature coefficient. An example of a circuit of this type is described in U.S. Pat. No. 2,231,999, where a variable resistance with negative temperature coefficient (NTC) is arranged in series with a resonant capacitor and the branch containing these two components is arranged in parallel with the lamp. In this case also the passage of current through the NTC resistance induces a variation in the resistance and hence in the total impedance in parallel with the lamp.

A further problem which arises in electronic ballasts consists of the protection of the lamp from the occurrence of overvoltages due to operating faults. To this end, many circuits have been devised which, by altering the resonant frequency of the load circuit, make it possible to limit the maximum voltage across the lamp. An example of a circuit of this type is described in EP-B-0 113 451. A different circuit solution, which avoids modification of the resonant frequency, is described in EP-A-0 610 642.

In conventional ballasts, the pre-heating circuit and the overvoltage protection circuit consist of separate elements.

OBJECTS AND SUMMARY OF THE INVENTION

A first object of the present invention consists in producing a circuit of the type mentioned, which allows better control of the lamp pre-heating phase.

A further object of the present invention is the production of a circuit which permits greater ease of design, without constraints on the conditions of operation of the pre-heating circuit.

Yet a further object of the present invention is that of producing a pre-heating circuit which also constitutes an overvoltage protection.

These and further objects and advantages, which will be clear to those skilled in the art from reading the text which follows, are obtained in a circuit of the type mentioned initially, in which the means for modifying the value of the impedance in parallel with the lamp comprise an inductive impedance which can be varied in a controlled manner.

In a particularly advantageous embodiment, the inductive impedance comprises a transformer, the primary winding of which is inserted into the circuit containing the lamp and the secondary winding of which can be short-circuited through a controllable switch which alternately takes on a closed or open condition.

In this manner, in the pre-heating phase the secondary winding of the transformer is short-circuited, in such a way that the equivalent impedance seen by the primary tends to zero. When the circuit of the secondary winding is opened, the impedance tends to infinity and similarly the equivalent impedance seen by the primary tends to infinity. Transferring between the condition of controllable switch closed and the condition of controllable switch open modifies the total value of the impedance in parallel with the lamp and hence the value of the resonant frequency of the load circuit.

Advantageously, the arrangement of the variable inductance and of the capacitors in the circuit in parallel with the lamp can be such that the controlled variation of the value of the inductance causes an alteration in the configuration of the capacitors and hence in the total value of the capacitance in parallel with the lamp. The alteration in the value of the total capacitance in parallel with the lamp includes a variation in the resonant frequency and hence in the voltage on the electrodes of the lamp. The variation is made to occur after an appropriate pre-heating time, subsequent to which the voltage on the electrodes can be made to increase in order to cause the firing of the lamp.

Just as in the known circuits based on the use of temperature-variable resistances, systems are known which use negative or positive coefficient resistances, so also in the present case the possibility is not excluded of keeping the circuit of the secondary open in the pre-heating phase and closed in the firing phase, by adopting a corresponding configuration of the circuit in parallel with the lamp.

In practice, the opening of the controllable switch can be obtained by means of a control circuit which opens the controllable switch after a phase of pre-heating of the lamp on the basis of the reaching of a prescribed condition, for example after a preset time interval. The delay circuit which controls the switching of the controllable switch can be activated by a standard switch for turning on the lamp, or by a remote control or alternatively by a presence sensor, that is to say a sensor which detects the presence of a person near the circuit and automatically turns on the lamp, after pre-heating.

The circuit can comprise two lamps; in this case the transformer comprises two uncoupled primary windings which can be wound on two lateral limbs of the core of the transformer, while the secondary winding is arranged on the central limb.

Further advantageous characteristics and embodiments of the circuit according to the invention are indicated in the attached dependent claims.

BRIEF DESCRIPTION OF THE DRAWINGS

The invention will be better understood by means of the description and the attached drawing which shows a non-limiting exemplary embodiment of the invention. In the drawing:

FIG. 4 shows a circuit, similar to the circuit of FIG. 1, but with two lamps;

FIG. 5 shows the configuration of the transformer in the case of the circuit of FIG. 4;

FIG. 6 shows a different configuration of the circuit of FIG. 1.

DETAILED DESCRIPTION OF THE INVENTION

Figure 1:
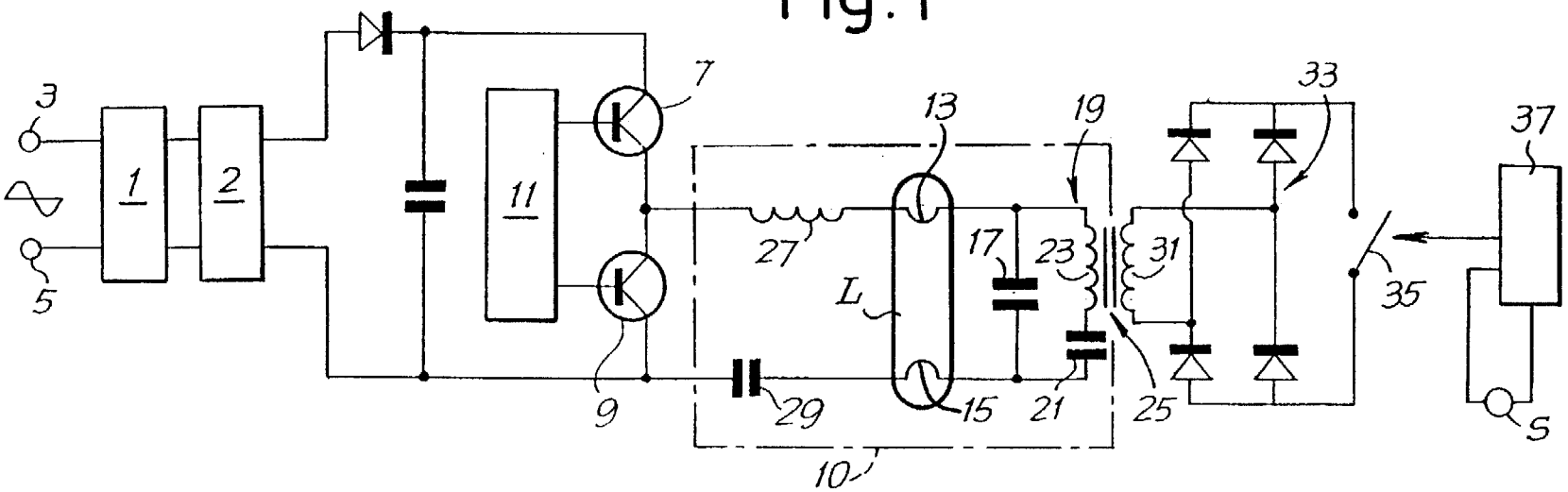
FIG. 1 shows a diagram of the circuit according to the invention.

Shown in FIG. 1 is the electronic reactor limited to the elements which are essential for explaining the invention. Circuit elements which are not relevant for the purposes of the present explanation and which are well known from the state of the art are omitted. In respect of these reference may be made, inter alia, to the prior publications cited in the introductory part.

The circuit has two terminals 3 and 5 which can be connected to a source of alternating voltage. The alternating voltage is supplied to a filter 1 and then to a rectifier 2. Two transistor switches 7, 9 controlled by a control circuit 11, of a type known per se, are provided at the outputs of the rectifier 2, in order to supply a load circuit indicated overall by 10.

The load circuit 10 comprises a lamp L with heated electrodes 13, 15, which is connected in parallel with the transistor 9. In parallel with the lamp, between and in series with its electrodes 13, 15, is connected a circuit comprising a first capacitor 17, placed in parallel with the lamp L and in parallel with a circuit branch 19, comprising a second capacitor 21 in series with a primary winding 23 of a transformer indicated overall as 25. The transformer 25 constitutes the inductive impedance of the circuit in parallel with the lamp L.

An inductance 27 and a third capacitor 29 also form part, in a manner known per se, of the load circuit, comprising the lamp L, the capacitor 17 and the branch 19.

The operation of the circuit described thus far is known per se and will not be explained in greater detail. The transistor switches 7 and 9 are brought alternately the one into make and the other into break in order to supply the load circuit 10 at a defined working frequency fL.

The secondary of the transformer 25, indicated as 31, is connected to a diode bridge 33 and to a controllable switch 35. The switch 35 can consist of a transistor, like the switches 7 and 9. The opening and closing of the controllable switch 35 is controlled by a control circuit, represented overall by the block 37.

The transformer 25 and the associated control circuit 37 constitute a device for pre-heating the lamp, which behaves in the following manner.

When the lamp L is fired (lamp cold), the controllable switch 35 is closed. Under these conditions, current flows in the branch 19 and hence the second capacitor 21 is connected in parallel with the first capacitor 17. The frequency of resonance between the inductance 27 and the two capacitors 17 and 21 is given by (ignoring the capacitor 29):

$$fo=2L(C17+C21) \quad (1)$$

where:

L is the inductance

C17 is the capacitance of the capacitor 17;

C21 is the capacitance of the capacitor 21.

Figure 2:
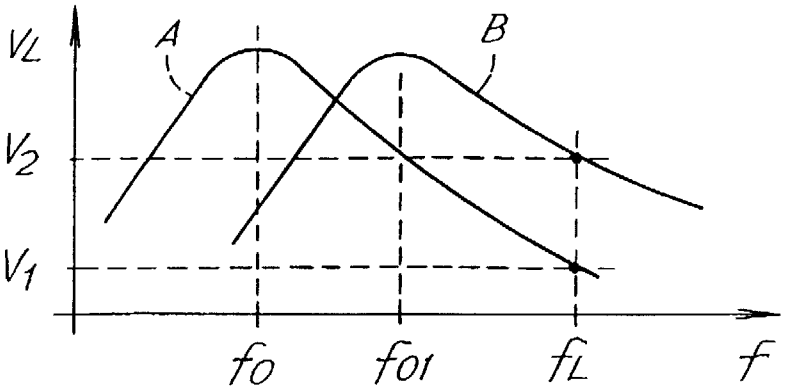
FIG. 2 shows a plot of the voltage at the lamp versus frequency.

The shape of the curve of the voltage VL on the lamp L versus the frequency f of supply is indicated by the curve A in FIG. 2, where fL indicates the effective working frequency, corresponding in this situation to a voltage V1 on the lamp L. This voltage is below the voltage necessary for triggering the lamp, while the electrodes heat up under the effect of the current flow through the capacitors 17 and 21.

After a certain pre-heating period, the control circuit 37 causes the opening of the controllable switch 35. Consequently, the impedance on the secondary winding 31 of the transformer 25 tends to infinity. Similarly the equivalent impedance seen by the primary winding 23 tends to infinity. Therefore the capacitor 21 becomes disconnected from the load circuit, with a consequent alteration in the frequency of resonance between the inductance 27 and the capacitor 17; this frequency of resonance becomes (again ignoring the capacitor 29):

$$f01=2LC17 \quad (2)$$

The voltage VL on the lamp L versus the supply frequency f in this new configuration is represented in the plot of FIG. 2 by the curve B. At the working frequency fL the voltage on the lamp passes from V1 to V2, that is to say to a value which causes firing.

Since transfer from the condition of operation with controllable switch 35 closed to the condition with switch 35 open is controlled by the circuit 37, it is possible to program the operation of the reactor in the desired manner. In a particularly simple embodiment the control circuit 37 can be a straightforward timer circuit, which opens the controllable switch 35 after a predetermined time interval. The control circuit 37 can be associated with a presence sensor S which causes activation of the circuit when the presence of a person is detected.

Figure 3:
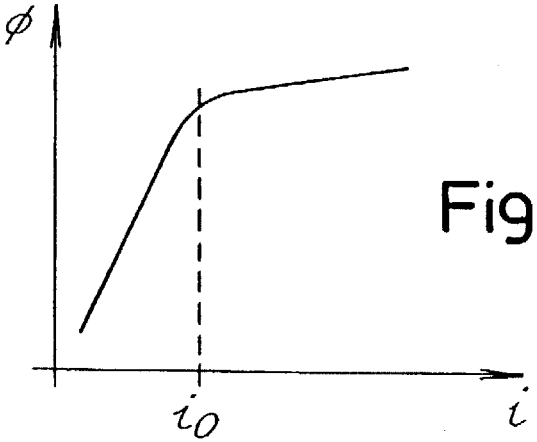
FIG. 3 shows a current/magnetic flux plot relating to the transformer of the pre-heating device.

The pre-heating circuit also replaces the overvoltage protection normally provided in reactors of this type, which cuts in in the event of a defective lamp so as to limit the voltage on the electrodes. What happens is that in the event of a defective lamp, the transformer 25 becomes saturated, i.e. the current flowing in the primary is greater than the value i0 (FIG. 3), so that the winding 23 behaves in a purely resistive manner. Consequently, the resonant frequency of the load circuit falls once again through the effect of the capacitor 21, which becomes reconnected in parallel with the capacitor 17, and the voltage on the electrodes 13, 15 falls, returning to the value V1 of the pre-heating phase.

Represented in FIG. 4 is a circuit similar to the circuit of FIG. 1, but with two lamps L1 and L2 in the same load circuit. Elements identical with or equivalent to those illustrated in FIG. 1 are indicated with the same reference numerals. The electrodes of the two lamps are indicated as 13A, 15A and 13B, 15B, respectively. Indicated as 41 is a lamp supply branch, with a coupling inductance 43 and a primary winding 45 which is wound on the same core of the transformer 25. Diagrammatically represented in FIG. 5 is the arrangement of the primary windings (23, 45) and secondary windings (31) on the core 26 of the transformer 25. The secondary is wound on the central limb, whilst the two primaries are wound on the two outer limbs, in such a way as to be mutually uncoupled.

Illustrated in FIG. 6 is an arrangement in which the capacitors 17 and 21 are arranged in series rather than in parallel. The primary winding 23 of the transformer 25 is arranged in parallel with the capacitor 21. In this way, when the controllable switch 35 is closed (pre-heating phase), the capacitor 21 is bypassed inasmuch as the equivalent inductance seen by the primary tends to zero. Conversely, when the controllable switch 35 is opened, the equivalent impedance tends to infinity and the two capacitors 17 and 21 form an arrangement of capacitances in series, the value of which is less than the value of the capacitance of the single capacitor 17.

The circuit solution of FIG. 6 differs from the solution of FIG. 1 both in the different arrangement of the capacitors, and in the different effect which the switching of the controllable switch 35 has on the configuration of the capacitors. Thus, in the configuration of FIG. 1 the winding 23 is in series with the capacitor 21, whilst in FIG. 6 it is in parallel with the said capacitor. Furthermore, in the first case with the opening of the controllable switch 35 transfer occurs from a configuration with two capacitors in parallel to a configuration with single capacitor. In the second case the opening of the controllable switch 35 causes a transfer from a configuration with single capacitor to a configuration with two capacitors in series. In both cases, however, the same inventive concept is applied, namely the use of a transformer with secondary circuit with controllable opening so as to transfer from the phase of pre-heating to the phase of firing the lamp.

I claim:

1. Circuit for firing and supplying a discharge lamp, comprising:

a load circuit, with at least one discharge lamp with heating electrodes;

supply voltage means for supplying said discharge lamp with voltage;

circuit means having a total impedance value in parallel with said lamp said circuit means including a circuit comprising at least one arrangement of capacitors;

impedance modification means for modifying the value of said total impedance in parallel with said lamp when said heating electrodes of the lamp have been heated, said impedance modification means including an inductive impedance which can be varied in a controlled manner, said inductive impedance being in parallel with said lamp.

2. Circuit according to claim 1, wherein said inductive impedance which can be varied in a controlled manner comprises a transformer, the primary winding of which is inserted into said circuit means containing the lamp and the secondary winding of which can be short-circuited through a controllable switch which alternately takes on a closed or open condition.

3. Circuit according to claim 1, wherein a variation in the value of the inductive impedance includes an alteration in said arrangement of capacitors and variation in the total capacitance in parallel with the lamp.

4. Circuit according to claim 2, wherein said controllable switch is associated with a control circuit which keeps said controllable switch closed in the pre-heating phase and opens said controllable switch after said phase of pre-heating of the lamp on the basis of the reaching of a prescribed condition.

5. Circuit according to claim 4, wherein said control circuit opens said controllable switch after a predetermined time from the starting up of the circuit.

6. Circuit according to claim 5, wherein a presence sensor is associated with said control circuit.

7. Circuit according to claim 1, wherein said circuit means comprises a first capacitor in parallel with said lamp and, in parallel with said first capacitor, a branch comprising a second capacitor in series with the primary winding of the transformer.

8. Circuit according to claim 1, wherein said circuit means comprises, in parallel with said lamp, a first and a second capacitor in series with one another and, in parallel with one of said two capacitors in series, a branch containing the primary winding of said transformer.

9. Circuit according to claim 2 wherein said lamp includes two lamps said transformer comprises two uncoupled primary windings.

10. Circuit according to claim 9, wherein said transformer has a core with three limbs, the secondary winding being wound on the central limb and the two primary windings being wound one on each of the two lateral limbs.

11. Circuit according to claim 2 further comprising two lamps as said lamp and a branch for supplying the two lamps having a coupling inductance and a primary winding wound on the core of said transformer.

12. Circuit for firing and supplying a discharge lamp, comprising:

a load circuit with at least one discharge lamp with heating electrodes;

supply means for supplying said discharge lamp;

LC circuit means connected to said discharge lamp, in parallel with said discharge lamp said circuit means including a circuit comprising at least two capacitors and an inductive impedance; and impedance modification means for modifying the value of the total impedance in parallel with said lamp when said heating electrodes of the lamp have been heated, said impedance modification means including varying means for modifying said inductor in a controlled manner.

13. Circuit according to claim 12, wherein said inductive impedance varying means comprises a transformer with a primary winding forming said inductive impedance of said LC circuit means and a secondary winding, and switching means for short-circuiting said secondary winding whereby a variation in a value of the inductive impedance includes a functional alteration in said arrangement of capacitors and a variation in the total capacitance in parallel with the lamp.

14. Circuit according to claim 13, wherein said switching means is associated a control circuit which keeps said switching means closed in the pre-heating phase and opens said switching means after said phase of pre-heating of the lamp on the basis of the reaching of a prescribed condition.

15. Circuit according to claim 13, wherein said control circuit opens said switching means after a predetermined time from the starting up of the circuit.

16. Circuit according to claim 15, wherein a presence sensor is associated with said control circuit.

17. Circuit according to claim 13, wherein said circuit means comprises a first capacitor in parallel with said lamp and, in parallel with said first capacitor, a branch comprising a second capacitor in series with the primary winding of the transformer.

18. Circuit according to claim 13, wherein said circuit means comprises, in parallel with said lamp, a first and second capacitor in series with one another and, in parallel with one of said two capacitors in series, a branch containing the primary winding of the said transformer.

19. Circuit according to claim 12, wherein said lamp includes two lamps and said transformer comprises two uncoupled primary windings and wherein said transformer has a core with three limbs, the secondary winding being wound on the central limb and the two primary windings being wound on each of the two lateral limbs.

20. Circuit for firing and supplying a discharge lamp, comprising:

a load circuit with at lest one discharge lamp;

supply means for supplying said discharge lamp;

LC circuit means connected to said discharge lamp, in parallel with said discharge lamp said circuit means including a circuit comprising at least two capacitors and an inductive impedance;

impedance modification means for modifying the value of the total impedance in parallel with said lamp, said impedance modification means including inductance varying means for modifying said inductor in a controlled manner with a transformer having a primary winding forming said inductive impedance of said LC circuit means and a secondary winding;

switching means for short-circuiting said secondary winding whereby a variation in a value of the inductive impedance includes a functional alteration in said arrangement of capacitors and a variation in the total capacitance in parallel with the lamp; and control circuit means for keeping said switching means closed in the pre-heating phase and open after said phase of pre-heating of the lamp on the basis of the reaching of a prescribed condition said condition including one or more of time and a sensed temperature threshold being exceeded.

* * * * *